US008112865B2

(12) United States Patent
Jang

(10) Patent No.: US 8,112,865 B2
(45) Date of Patent: Feb. 14, 2012

(54) REFRIGERATOR CABLE EJECTION METHOD

(75) Inventor: Jung Doo Jang, Gwangju (KR)

(73) Assignee: Samsung Electronics Co., Ltd., Gwangsan-gu, Gwangju-Shi (KR)

( * ) Notice: Subject to any disclaimer, the term of this patent is extended or adjusted under 35 U.S.C. 154(b) by 880 days.

(21) Appl. No.: 12/138,940

(22) Filed: Jun. 13, 2008

(65) Prior Publication Data

US 2009/0108724 A1 Apr. 30, 2009

(30) Foreign Application Priority Data

Oct. 24, 2007 (KR) ..... 10-2007-0107063

(51) Int. Cl.
*B21D 39/00* (2006.01)
*A47B 96/00* (2006.01)

(52) U.S. Cl. ..... 29/433; 29/525.01; 29/527.1; 312/406

(58) Field of Classification Search ..... 29/241, 29/423, 433, 464, 525.01, 527.1; 312/406, 312/409

See application file for complete search history.

(56) References Cited

U.S. PATENT DOCUMENTS

| | | | | |
|---|---|---|---|---|
| 4,684,161 | A * | 8/1987 | Egner et al. | 294/1.1 |
| 4,715,512 | A * | 12/1987 | Buchser | 220/592.1 |
| 4,805,293 | A * | 2/1989 | Buchser | 29/460 |
| 5,941,619 | A * | 8/1999 | Stieben et al. | 312/223.6 |
| 7,216,864 | B2 * | 5/2007 | Yoshihara | 271/145 |

FOREIGN PATENT DOCUMENTS

KR 20-0136613 3/1999

* cited by examiner

*Primary Examiner* — Jermie Cozart

(74) *Attorney, Agent, or Firm* — Ohlandt, Greeley, Ruggiero & Perle, L.L.P.

(57) ABSTRACT

The refrigerator cable ejection method is used to eject one end of a cable out of an outer liner through an ejection hole formed at the outer liner before a filling space is filled with a foam insulation material in a refrigerator constructed in a structure in which the outer liner is fitted outside an inner liner, the cable is distributed in the filling space defined between the inner liner and the outer liner, and the filling space is filled with a foam insulation material while the cable is distributed in the filling space. The method is performed to eject one end of the cable out of the outer liner through the ejection hole at the time of fitting the outer liner outside the inner liner using an ejector including a pass-through member mounted outside the inner liner corresponding to the ejection hole such that the cable passes through the member.

6 Claims, 4 Drawing Sheets

REFRIGERATOR CABLE EJECTION METHOD

CROSS-REFERENCE TO RELATED APPLICATION

This application claims the benefit of Korean Patent Application No. 2007-0107063, filed on Oct. 24, 2007 in the Korean Intellectual Property Office, the disclosure of which is incorporated herein by reference.

BACKGROUND OF THE INVENTION

1. Field of the Invention

The present invention relates to a refrigerator cable ejection method, and, more particularly, to a refrigerator cable ejection method that is capable of more easily ejecting a cable distributed in a refrigerator outside the refrigerator at the time of manufacturing the refrigerator.

2. Description of the Related Art

Generally, a refrigerator includes a refrigerator body having a storage chamber defined therein, the storage chamber being open at the front thereof, and a door rotatably hinged to the front of the refrigerator body to open or close the storage chamber.

At the inside rear of the storage chamber is mounted an evaporator, of a refrigeration cycle, to generate cool air. Consequently, food is stored in the storage chamber for a long time in a refrigerated or frozen state by the cool air generated by the evaporator.

The refrigerator further includes other components of the refrigeration cycle, such as a condenser, a compressor, an expanding device, an ice maker to make ice, and various electronic parts such as a lighting unit and a display unit. In the refrigerator body is distributed a cable to supply power to the electronic parts.

The refrigerator body includes an inner liner configured to be open at the front thereof such that a space defined by the inner liner constitutes the storage chamber, an outer liner configured to be fitted outside the inner liner, and a foam insulation material filled between the inner liner and the outer liner. Between the inner liner and the outer liner is defined a filling space which is filled with the foam insulation material. The cable is distributed in the filling space before the filling space is filled with the foam insulation material. One end of the cable is ejected out of the outer liner, and the other end of the cable is guided to the respective electronic parts. After the cable is ejected out of the outer liner, a plug is mounted at the ejected end of the cable through a post process.

The cable ejection is achieved by a worker pushing one end of the cable into an ejection hole formed at one end of the outer liner inside the outer liner spaced apart somewhat from the inner liner before fitting the outer liner outside the inner liner. In this state, the outer liner is fitted outside the inner liner.

In the conventional refrigerator with the above-stated construction, however, the worker pushes the cable into the narrow ejection hole, formed at the outer liner, while holding one end of the cable, to eject the cable. As a result, it is difficult to push the cable into the ejection hole.

Furthermore, the cable ejection process is performed before fitting the outer liner outside the inner liner. Consequently, when the outer liner is pushed to the inner liner, such that the outer liner is fitted outside the inner liner, after the cable is ejected, the length of the cable ejected out of the outer liner is excessive. As a result, it is necessary to cut the end of the cable ejected out of the outer liner, such that the ejected end of the cable has a predetermined length, or pull the ejected cable into the filling space, such that the ejected end of the cable has an appropriate length. In the conventional art, therefore, the process to eject the cable, distributed in the refrigerator, out of the outer liner is very troublesome.

SUMMARY OF THE INVENTION

Therefore, it is an aspect of the invention to provide a refrigerator cable ejection method that is capable of more easily ejecting a cable distributed in a refrigerator outside the refrigerator at the time of manufacturing the refrigerator.

In accordance with one aspect, the present invention provides a refrigerator cable ejection method to eject one end of a cable out of an outer liner through an ejection hole formed at the outer liner before a filling space is filled with a foam insulation material in a refrigerator constructed in a structure in which the outer liner is fitted outside an inner liner, the cable is distributed in the filling space defined between the inner liner and the outer liner, and the filling space is filled with a foam insulation material while the cable is distributed in the filling space, wherein the refrigerator cable ejection method is performed to eject one end of the cable out of the outer liner through the ejection hole at the time of fitting the outer liner outside the inner liner using an ejector including a pass-through member mounted outside the inner liner corresponding to the ejection hole such that the cable passes through the pass-through member and a guide member constructed in a hollow structure to receive the cable, passing through the pass-through member, the guide member being detachably coupled to the pass-through member such that the guide member is ejected out of the outer liner together with the cable received in the guide member through the ejection hole at the time of fitting the outer liner outside the inner liner, and, subsequently, the guide member is separated from the pass-through member.

Preferably, the ejector further includes a bracket mounted at the outside of the inner liner, and the pass-through member is mounted at the outside of the inner liner through the bracket.

Preferably, the bracket is mounted at the outside bottom of one corner of the inner liner adjacent to the outer liner in a supported fashion, and the ejection hole is formed at the outer liner corresponding to the bracket.

Preferably, the pass-through member includes a bracket coupling part coupled to the bracket, a guide member coupling part to which the guide member is detachably coupled, the guide member coupling part being configured to be ejected out of the ejection hole together with the guide member, and an outer liner support part disposed between the bracket coupling part and the guide member coupling part, the outer liner support part being configured to be supported at the inside of the outer liner around the ejection hole in a state in which the guide member coupling part is ejected out of the ejection hole, and the cable passes from the bracket coupling part to the guide member coupling part.

Preferably, the bracket coupling part is rotatably coupled to the bracket, the pass-through member further includes a rotation guide part disposed between the outer liner support part and the guide member coupling part, the rotation guide part being configured to be located at the ejection hole, in a state in which the guide member coupling part is ejected out of the ejection hole, to allow the rotation of the pass-through member, and the ejection hole and the guide member coupling part are configured such that the guide member coupling part is fixed to the outer liner in a state in which the guide member coupling part and the ejection hole cross each other by rotating the pass-through member in a state in which the rotation guide part is located in the ejection hole.

Preferably, the ejection hole is formed in the shape of a long hole, and the guide member coupling part has a shape and size corresponding to the ejection hole.

Preferably, the guide member is provided at the ejection-direction end thereof, ejected through the ejection hole, with a tip end.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
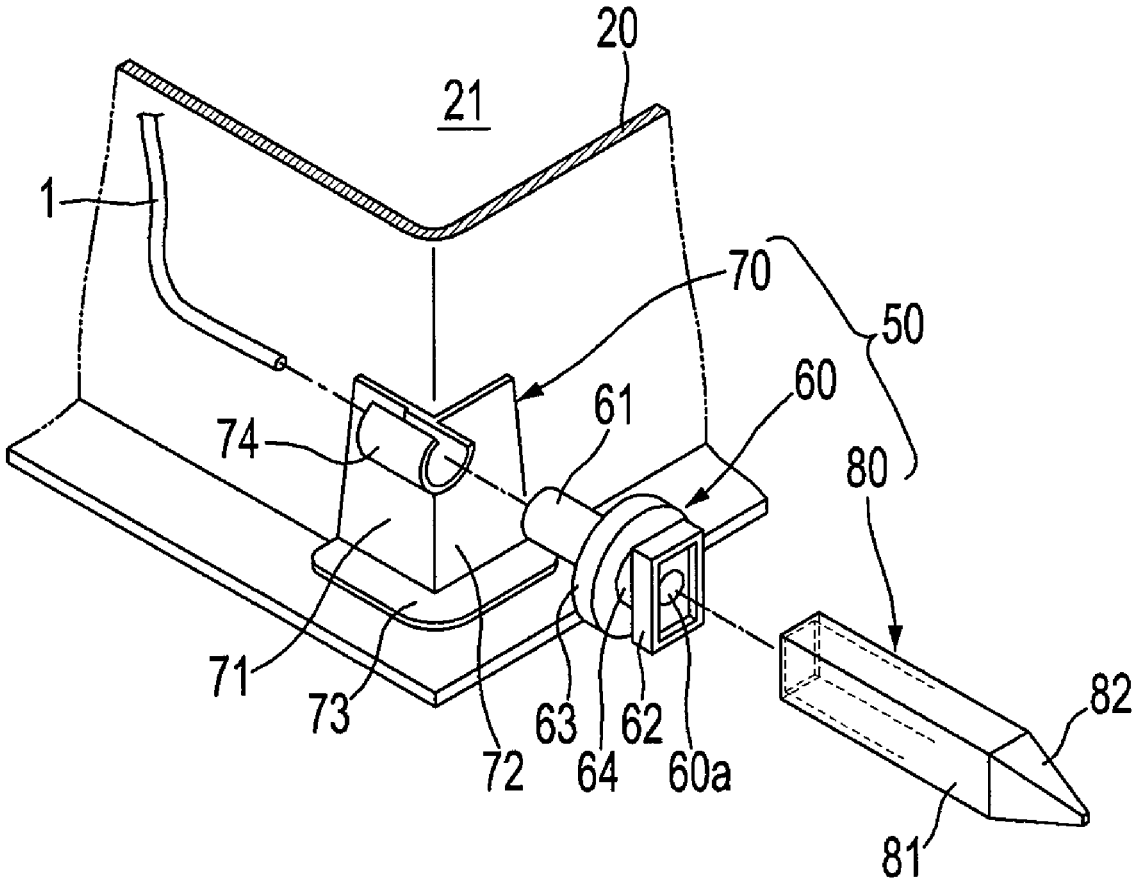
FIG. 1 is an exploded perspective view illustrating the structure of principal components of a refrigerator to which a refrigerator cable ejection method according to the present invention is applied, including the structure of an ejector used to perform the refrigerator cable ejection method.

Reference will now be made in detail to the embodiment of the present invention, examples of which are illustrated in the accompanying drawings, wherein like reference numerals refer to like elements throughout. The embodiment is described below to explain the present invention by referring to the figures.

FIGS. 1 to 4 illustrate the structure of principal components of a refrigerator to which a refrigerator cable ejection method according to the present invention is applied, including the structure of an ejector 50 used to eject a cable 1 out of a refrigerator body 10.

The refrigerator includes a refrigerator body 10 having a storage chamber 21 defined therein, the storage chamber 21 being open at the front thereof, and a door (not shown) rotatably hinged to the front of the refrigerator body 10 to open or close the storage chamber 21.

The refrigerator body 10 includes an inner liner 20 configured to be open at the front thereof such that a space defined by the inner liner 20 constitutes the storage chamber 21, an outer liner 30 configured to be fitted outside the inner liner 20, and a foam insulation material 40 filled between the inner liner 20 and the outer liner 30. Between the inner liner 20 and the outer liner 30 is defined a filling space 41 which is filled with the foam insulation material 40.

The refrigerator further includes an evaporator to generate cool air to cool the interior of the storage chamber 21, a condenser/compressor/expanding device constituting a refrigeration cycle together with the evaporator, an ice maker to make ice, and various electronic parts (not shown) such as a lighting unit and a display unit mounted at the front of the door (not shown). In the filling space 41 is distributed a cable to supply power to the electronic parts (not shown).

The cable 1 is distributed in the filling space 41 before the filling space 41 is filled with the foam insulation material 40. One end of the cable 1 is ejected out of the refrigerator body 10 through an injection hole 31 formed at one side of the outer liner 30, and the other end of the cable 1 is guided to the respective electronic parts (not shown). After the cable 1 is ejected out of the outer liner 30, a plug (not shown) is mounted at the ejected end of the cable 1 through a post process.

Meanwhile, the ejector 50, used at the time of ejecting the cable 1, includes a pass-through member 60 mounted outside the inner liner 20 corresponding to the ejection hole 31, the pass-through member 60 having a pass-through hole **60*a* formed in the longitudinal direction thereof such that the cable 1 passes through the pass-through hole 60*a*, a bracket 70 mounted at the outside of the inner liner 20 to fix the pass-through member 60, and a guide member 80 detachably coupled to the pass-through member 60 to guide the ejection of the cable 1**.

The bracket 70 allows the pass-through member 60 to be mounted at the outside of the inner liner 20 without the structural modification of the inner liner 20. The bracket 70 is mounted at the outside bottom of one corner of the inner liner 20 adjacent to the outer liner 30 in a supported fashion.

Specifically, the bracket 70 includes first and second support parts 71 and 72 configured to be supported at adjacent sides of one corner of the inner liner 20 and a third support part 73 configured to be supported at the bottom of one corner of the inner liner 20. Consequently, the bracket 70 is stably supported at the outside of the inner liner 20. The bracket 70 may be supported at the outside of the inner liner 20 while the bracket 70 is fixed to the inner liner 20 by an adhesive tape (not shown). The ejection hole 31 is preferably formed at the outer liner 30 corresponding to the bottom of one corner of the inner liner 20 such that the ejection hole 31 corresponds to the pass-through member 60 mounted at the bracket 70.

The guide member 80 is constructed in a hollow structure in which one end of the guide member 80 is open and the other end of the guide member 80 is closed such that the cable 1, passing through the pass-through member 60, is received in the guide member 80. One end of the guide member 80 is fixed to a guide member coupling part 62 of the pass-through member 60.

The guide member 80 is coupled to the pass-through member 60, one end of the cable 1 is inserted into the guide member 80 through the pass-through member 60, and the pass-through member 60 is coupled to the bracket 70. Subsequently, the outer liner 30 is pushed to the inner liner 20 from the rear of the inner liner 20 such that the outer liner 30 is fitted outside the inner liner 20. As a result, the guide member 80 is ejected out of the outer liner 30 through the ejection hole 31 because the pass-through member 60 is located at a position corresponding to the ejection hole 31. At this time, the cable 1, extending into the guide member 80, is ejected out of the ejection hole 31 together with the guide member 80. Consequently, when the guide member 80 is pulled out of the outer liner 30 such that the guide member 80 is separated from the pass-through member 60, the guide member 80 is removed from the outer liner 30, and, at the same time, one end of the cable 1, received in the guide member 80, is exposed outside while being ejected out of the outer liner 30.

The guide member 80 includes a square pillar-shaped member body 81 configured to be coupled to the pass-through member 60 and a tip end 82 formed at the ejection-direction end of the guide member 80 to guide the ejection of the guide member 80.

The open end of the member body 81 is inserted into the guide member coupling part 62, with the result that the guide member 80 is fixed to the pass-through member 60. The length of the guide member 80 is decided in consideration of the ejected length of the cable 1 ejected out of the outer liner 30. The ejected length of the cable 1 is appropriately decided.

The pass-through member 60 includes a bracket coupling part 61 coupled to the bracket 70 while being backed up by the bracket 70, a guide member coupling part 62 to which the guide member 80 is detachably coupled, the guide member coupling part 62 being configured to be ejected out of the ejection hole 31 together with the guide member 80, an outer liner support part 63 disposed between the bracket coupling part 61 and the guide member coupling part 62, the outer liner support part 63 being configured to be supported at the inside of the outer liner around the ejection hole 31 in a state in which the guide member coupling part 62 is ejected out of the ejection hole 31, and a rotation guide part 64 disposed between the outer liner support part 63 and the guide member coupling part 62, the rotation guide part 64 being configured to be located at the ejection hole 31, in a state in which the guide member coupling part 62 is ejected out of the ejection hole 31, to allow the rotation of the pass-through member 60.

The bracket coupling part 61, the outer liner support part 63, the rotation guide part 64, and the guide member coupling part 62 are integrated in the pass-through direction of the cable 1 such that the bracket coupling part 61, the outer liner support part 63, the rotation guide part 64, and the guide member coupling part 62 are sequentially formed from one end to the other end of the pass-through member 60. The pass-through hole 60*a* is configured to sequentially extend through the bracket coupling part 61, the outer liner support part 63, the rotation guide part 64, and the guide member coupling part 62.

A back-up part 74 is integrally formed at the upper part of the first support part 71 of the bracket 70 such that the bracket coupling part 61 of the pass-through member 60 is coupled to the back-up part 74 in a state in which the bracket coupling part 61 is backed up by the back-up part 74. The bracket coupling part 61 is formed in the shape of a rod such that the pass-through member 60 can rotate in a state in which the bracket coupling part 61 is coupled to the back-up part 74 in such a manner that the bracket coupling part 61 is backed up by the back-up part 74. The back-up part 74 is configured to surround at least half of the outside of the bracket coupling part 61 such that the back-up part 74 rotatably supports the bracket coupling part 61. By the rotation of the pass-through member 60, the pass-through member 60 is fixed in the ejection hole 31 in a state in which the cable 1 is ejected. Consequently, the pass-through member 60 remains stably fixed in the ejection hole 31 when the filling space is filled with the foam insulation material 40 in a state in which the cable 1 is ejected.

Specifically, the ejection hole 31 is formed in the shape of a rectangular long hole having a vertical length greater than a lateral length. The guide member coupling part 62 of the pass-through member 60 is formed in the shape of a rectangular box having a shape and size corresponding to the ejection hole 31 and open toward the outer liner 30 such that the guide member coupling part 62 can pass through the ejection hole 31.

Figure 3:
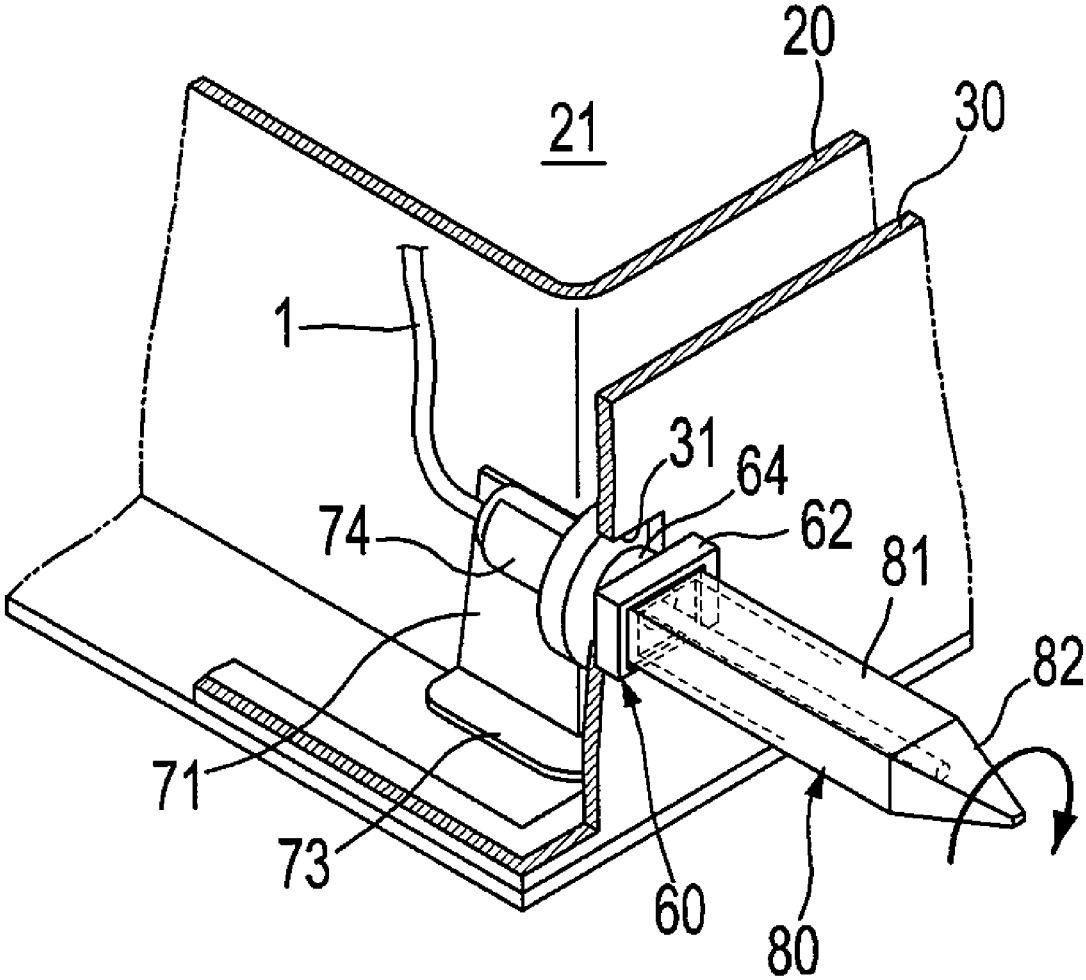
FIG. 3 is a perspective view illustrating the cable ejecting process based on the refrigerator cable ejection method according to the present invention, a pass-through member of the ejector being fixed in an ejection hole by rotating a guide member of the ejector in a state in which the outer liner is fitted outside the inner liner of the refrigerator.
Figure 4:
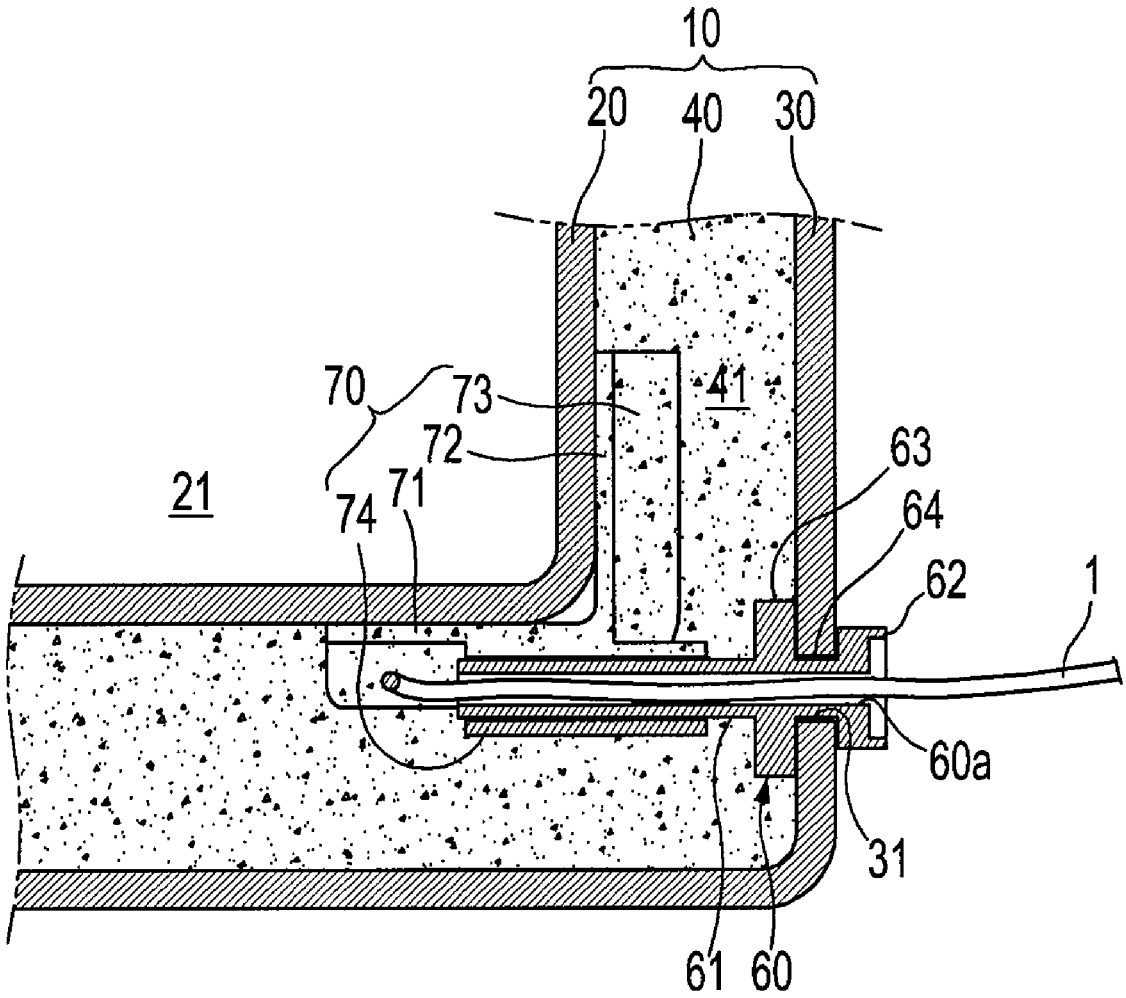
FIG. 4 is a perspective view illustrating the completion of the cable ejecting process based on the refrigerator cable ejection method according to the present invention, a filling space being filled with a foam insulation material.

Consequently, when the pass-through member 60 is rotated such that the guide member coupling part 62 and the ejection hole 31 cross each other in a state in which the guide member coupling part 62 is ejected out of the ejection hole 31 and the rotation guide part 64 is located in the ejection hole 31, as shown in FIGS. 3 and 4, the guide member coupling part 62 is caught in the ejection hole 31 in a state in which the outer liner support part 63 and the guide member coupling part 62 are supported inside and outside the ejection hole 31, whereby the pass-through member 60 is fixed in the ejection hole 31 without using an adhesive.

At this time, it is possible to conveniently perform the rotation of the pass-through member 60 while holding the guide member 80 ejected out of the ejection hole 31. It is preferred to remove the guide member 80 in a state in which the pass-through member 60 is fixed in the ejection hole 31.

Hereinafter, a refrigerator cable ejection method using the ejector 50 with the above-stated construction will be described in detail.

First, in a state of FIG. 1, a worker fixes the bracket 70 to the bottom of one corner of the inner liner 20 corresponding to the ejection hole 31, such that the bracket 70 is supported by the inner liner 20, using a tape (not shown).

Figure 2:
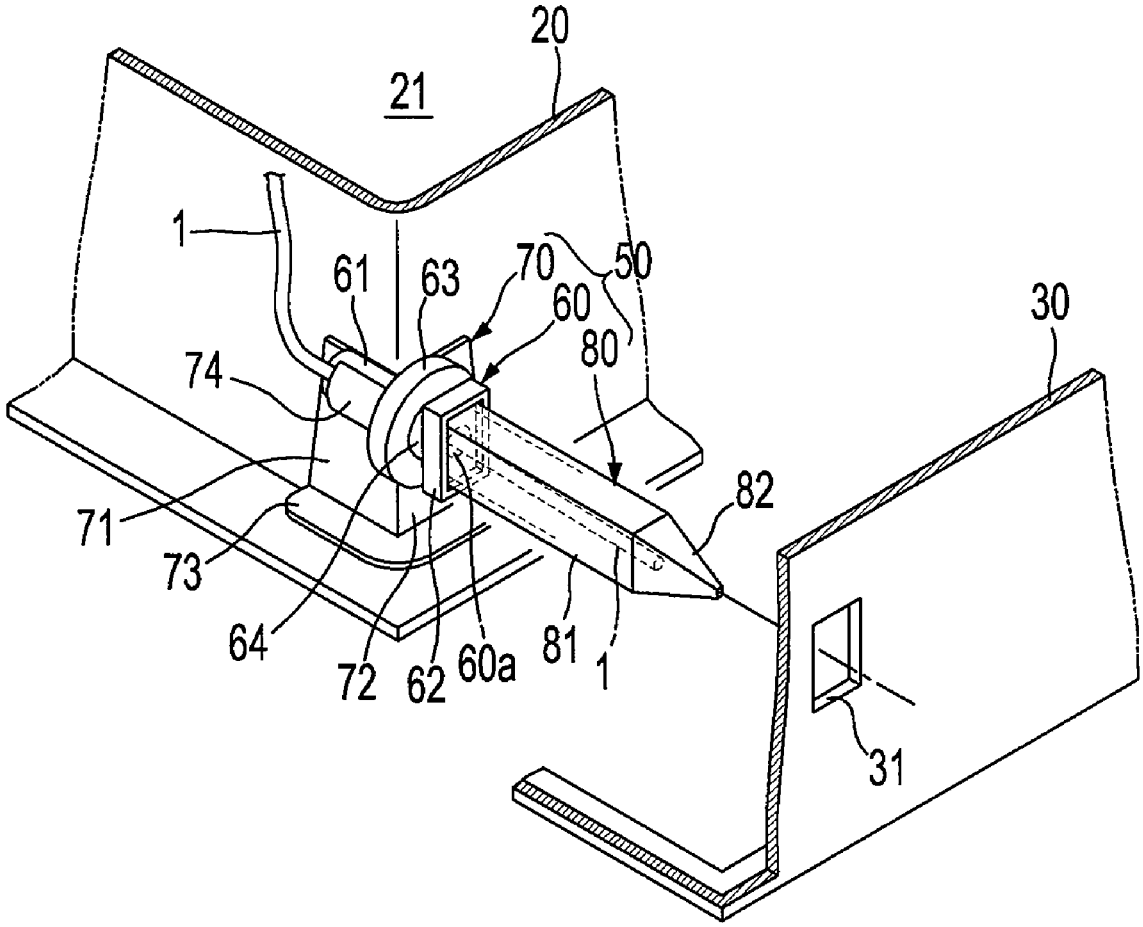
FIG. 2 is a perspective view illustrating a cable ejecting process based on the refrigerator cable ejection method according to the present invention before an outer liner is fitted outside an inner liner of the refrigerator.

Subsequently, when one end of the member body 81 of the guide member 80 is inserted into the guide member coupling part 62 of the pass-through member 60, such that the guide member 80 is coupled to the pass-through member 60, and one end of the cable 1 is pushed into the pass-through hole 60*a* of the pass-through member 60, the one end of the cable, passing through the pass-through member 60, extends into the guide member 80. In this state, the bracket coupling part 61 of the pass-through member 60 is coupled to the back-up part 74 of the bracket 70 in such a manner that the bracket coupling part 61 is backed up by the back-up part 74. As a result, the pass-through member 60, to which the guide member 80 is coupled, is fixed to the bracket 70 such that the pass-through member 60 is rotatably supported by the bracket 70. This state is shown in FIG. 2.

In this state, the outer liner 30 is fitted outside the inner liner 20. Since the ejection hole 31 corresponds to the pass-through member 60 and the guide member 80, the guide member coupling part 62 of the pass-through member 60 and the guide member, coupled to the guide member coupling part 62, are ejected out of the outer liner 30 through the ejection hole 31 at the time of fitting the outer liner outside the inner liner 20. At this time, one end of the cable 1, received in the guide member 80, is also ejected out of the ejection hole 31 together with the guide member 80.

In a state in which the one end of the cable 1 is ejected out of the outer liner 30 together with the guide member 80, the worker rotates the pass-through member 80, such that the guide member coupling part 62 and the ejection hole 31 cross each other, while holding the guide member 80 ejected out of the outer liner 30. As a result, the pass-through member 60 is fixed in the ejection hole 31, as shown in FIG. 3. Subsequently, when the guide member 80 is pushed out of the outer liner 30 such that the guide member 80 is separated from the pass-through member 60, the guide member 80 is removed from the outer liner 30, whereby the one end of the cable 1, received in the guide member 80, is exposed in a state in which the one end of the cable 1 is ejected out of the outer liner 30.

In this state, the filling space 41, defined between the inner liner 20 and the outer liner 30, is filled with the foam insulation material 40. At this time, the pass-through member 60 is fixed in the ejection hole 31, and therefore, the fixation between the pass-through member 60 and the ejection hole 31 is maintained even though the foam insulation material 40 collides with the pass-through member 60 when the filling space 41 is filled with the foam insulation material 40.

In a state in which the filling of the foam insulation material 40 is completed, as shown in FIG. 4, the bracket 70 and the pass-through member 60 are more securely fixed in the filling space 41 by virtue of the foam insulation material 40. A plug (not shown) is mounted at the ejected end of the cable 1 through a post process.

In the refrigerator cable ejection method according to this embodiment, one end of the cable 1, distributed in the filling space 41, is ejected out of the outer liner 30 at the time of fitting the outer liner 30 outside the inner liner 20. Consequently, it is possible to more simply perform the cable ejecting process.

Also, in the refrigerator cable ejection method according to the present invention, the length of the cable 1 extending into the guide member 80 through the pass-through member 60 corresponds to that of the cable 1 finally ejected out of the outer liner 30. Consequently, it is possible to appropriately adjust the length of the cable 1 to be ejected out of the outer liner 30, before fitting the outer liner 30 outside the inner liner 20, whereby it is not necessary to readjust the length of the cable 1 ejected out of the outer liner 30. Consequently, it is possible to more easily perform the cable ejecting process.

As apparent from the above description, the refrigerator cable ejection method according to the present invention has the effect of ejecting one end of a cable out of an outer liner through an ejector at the time of fitting the outer liner outside an inner liner and easily adjusting the length of the cable ejected out of the outer liner, thereby more easily performing a refrigerator cable ejecting process.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator cable ejection method to eject one end of a cable out of an outer liner through an ejection hole formed at the outer liner before a filling space is filled with a foam insulation material in a refrigerator constructed in a structure in which the outer liner is fitted outside an inner liner, the cable is distributed in the filling space defined between the inner liner and the outer liner, and the filling space is filled with a foam insulation material while the cable is distributed in the filling space, the refrigerator cable ejection method comprising:

ejecting one end of the cable out of the outer liner through the ejection hole at the time of fitting the outer liner outside the inner liner using an ejector including a pass-through member mounted outside the inner liner corresponding to the ejection hole such that the cable passes through the pass-through member and a guide member constructed in a hollow structure to receive the cable, passing through the pass-through member, the guide member being detachably coupled to the pass-through member such that the guide member is ejected out of the outer liner together with the cable received in the guide member through the ejection hole at the time of fitting the outer liner outside the inner liner, and, subsequently, the guide member is separated from the pass-through member, wherein the ejector further includes a bracket mounted at the outside of the inner liner, and the pass-through member is mounted at the outside of the inner liner through the bracket.

2. The refrigerator cable ejection method according to claim 1, wherein the bracket is mounted at the outside bottom of one corner of the inner liner adjacent to the outer liner in a supported fashion, and the ejection hole is formed at the outer liner corresponding to the bracket.

3. The refrigerator cable ejection method according to claim 1, wherein the pass-through member includes a bracket coupling part coupled to the bracket, a guide member coupling part to which the guide member is detachably coupled, the guide member coupling part being configured to be ejected out of the ejection hole together with the guide member, and an outer liner support part disposed between the bracket coupling part and the guide member coupling part, the outer liner support part being configured to be supported at the inside of the outer liner around the ejection hole in a state in which the guide member coupling part is ejected out of the ejection hole, and the cable passes from the bracket coupling part to the guide member coupling part.

4. The refrigerator cable ejection method according to claim 3, wherein the bracket coupling part is rotatably coupled to the bracket, the pass-through member further includes a rotation guide part disposed between the outer liner support part and the guide member coupling part, the rotation guide part being configured to be located at the ejection hole, in a state in which the guide member coupling part is ejected out of the ejection hole, to allow the rotation of the pass-through member, and the ejection hole and the guide member coupling part are configured such that the guide member coupling part is fixed to the outer liner in a state in which the guide member coupling part and the ejection hole cross each other by rotating the pass-through member in a state in which the rotation guide part is located in the ejection hole.

5. The refrigerator cable ejection method according to claim 4, wherein the ejection hole is formed in the shape of a long hole, and the guide member coupling part has a shape and size corresponding to the ejection hole.

6. The refrigerator cable ejection method according to claim 1, wherein the guide member is provided at the ejection-direction end thereof, ejected through the ejection hole, with a tip end.

* * * * *